US010330281B2

(12) United States Patent
Kang

(10) Patent No.: US 10,330,281 B2
(45) Date of Patent: Jun. 25, 2019

(54) LIGHTING DEVICE

(71) Applicant: LG INNOTEK CO., LTD., Seoul (KR)

(72) Inventor: Min Soo Kang, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 118 days.

(21) Appl. No.: 15/505,552

(22) PCT Filed: Aug. 12, 2015

(86) PCT No.: PCT/KR2015/008422

§ 371 (c)(1),
(2) Date: Feb. 21, 2017

(87) PCT Pub. No.: WO2016/028024

PCT Pub. Date: Feb. 25, 2016

(65) Prior Publication Data

US 2017/0284629 A1 Oct. 5, 2017

(30) Foreign Application Priority Data

Aug. 22, 2014 (KR) ..... 10-2014-0109574

(51) Int. Cl.

| | |
|---|---|
| ***F21V 5/00*** | (2018.01) |
| ***F21V 5/04*** | (2006.01) |
| ***F21V 17/00*** | (2006.01) |
| ***F21V 3/00*** | (2015.01) |
| ***F21V 19/00*** | (2006.01) |
| ***F21V 23/02*** | (2006.01) |
| *F21Y 115/10* | (2016.01) |

(Continued)

(52) U.S. Cl.

CPC ..... *F21V 5/007* (2013.01); *F21V 3/00* (2013.01); *F21V 5/04* (2013.01); *F21V 17/00* (2013.01); *F21V 19/003* (2013.01); *F21V 23/02* (2013.01); *F21Y 2105/12* (2016.08); *F21Y 2105/16* (2016.08); *F21Y 2115/10* (2016.08)

(58) Field of Classification Search

CPC ..... F21V 5/007; F21V 3/00; F21V 19/003; F21V 23/02

USPC ..... 362/235

See application file for complete search history.

(56) References Cited

U.S. PATENT DOCUMENTS

2012/0256205 A1 10/2012 Low et al.
2016/0084469 A1* 3/2016 Fukui ..... F21S 48/2212 362/521

FOREIGN PATENT DOCUMENTS

JP 2009-026635 2/2009
JP 2011-060685 3/2011

(Continued)

OTHER PUBLICATIONS

International Search Report (with English Translation) and Written Opinion dated Nov. 11, 2015 issued in Application No. PCT/KR2015/008422.

*Primary Examiner* — Elmito Breval
(74) *Attorney, Agent, or Firm* — Ked & Associates LLP

(57) ABSTRACT

An embodiment comprises: a housing comprising a lower plate and a side plate; a substrate arranged on the lower plate; a light-emitting module comprising light sources arranged on the substrate and spaced from each other; and a lens array unit comprising lenses arranged so as to correspond to the light sources. The light sources have different magnitudes of quantity of light, and the sizes of the lenses are proportional to the magnitudes of quantity of light of the corresponding light sources.

20 Claims, 9 Drawing Sheets

(51) Int. Cl.
*F21Y 105/16* (2016.01)
*F21Y 105/12* (2016.01)

(56) References Cited

FOREIGN PATENT DOCUMENTS

| | | |
|---|---|---|
| JP | 2013-101767 | 5/2013 |
| JP | 2013-211184 | 10/2013 |
| KR | 10-2011-0097302 | 8/2011 |
| KR | 10-2013-0053322 | 5/2013 |
| KR | 10-2014-0009923 | 1/2014 |

* cited by examiner

| Arrangement of light source | 24a1 | 24b1 | 24a2 | 24b2 | 24a3 | 24b3 | 24a4 |
|---|---|---|---|---|---|---|---|
| Type of light source | B-TYPE | A-TYPE | B-TYPE | A-TYPE | B-TYPE | A-TYPE | B-TYPE |
| Lens (Size) | 32a1 (R1) | 32b1 (R2) | 32a2 (R1) | 32b2 (R2) | 32a3 (R1) | 32b3 (R2) | 32a4 (R1) |

LIGHTING DEVICE

CROSS-REFERENCE TO RELATED PATENT APPLICATIONS

This application is a U.S. National Stage Application under 35 U.S.C. § 371 of PCT Application No. PCT/KR2015/008422, filed Aug. 12, 2015,which claims priority to Korean Patent Application No. 10-2014-0109574, filed Aug. 22, 2014, whose entire disclosures are hereby incorporated by reference.

TECHNICAL FIELD

Embodiments relate to a lighting device.

BACKGROUND ART

A fluorescent lamp, which is commonly used for a lighting device, is operated at a frequency of 60 Hz, leading to severe eye fatigue due to flickering when it is used for a long period of time.

Further, when the fluorescent lamp is used for a long period of time, it may increase the ambient temperature due to self-heating, and may cause high electric loss.

In contrast, an LED lamp has advantages in that the efficiency of conversion of electric power into light is remarkably high, it produces highly efficient intensity of illumination at low voltage, it has anti-glare properties, and the operational stability is excellent, with the result that an LED lamp has come to be widely used for lighting devices.

A light-emitting module, which includes a plurality of LEDs as a light source, is employed as a lighting device, in which maintenance of uniform luminance is required in order to relieve user eye fatigue.

DISCLOSURE

Technical Problem

Embodiments provide a lighting device capable of improving luminance uniformity and color uniformity and of preventing yield reduction.

Technical Solution

A lighting device according to an embodiment includes a housing including a lower plate and a side plate, a light-emitting module including a substrate disposed on the lower plate and light sources disposed on the substrate, and a lens array unit including lenses arranged corresponding to the light sources, in which the light sources include light sources emitting each other, and sizes of the lenses are proportional to a quantity of light from the light sources.

At least one of separation distances between the adjacent light sources may be different from the other separation distances.

A center of each of the lenses may be aligned with a center of a corresponding one of the light sources.

The quantity of light from the light sources may decrease moving away from a center line of the housing in a direction perpendicular to the center line of the housing. The sizes of the lenses may decrease moving away from the center line of the housing in the direction perpendicular to the center line of the housing.

The separation distance between adjacent light sources and the separation distance between adjacent lenses may decrease moving away from the center line of the housing in the direction perpendicular to the center line of the housing.

The quantity of light from the light sources may increase moving away from the center line of the housing in the direction perpendicular to the center line of the housing.

The sizes of the lenses may increase moving away from the center line of the housing in the direction perpendicular to the center line of the housing.

The separation distance between adjacent light sources and the separation distance between adjacent lenses may increase moving away from the center line of the housing in the direction perpendicular to the center line of the housing.

A lighting device according to another embodiment includes a housing including a lower plate and a side plate, a light-emitting module including a substrate disposed on the lower plate and light sources disposed on the substrate, and a lens array unit including lenses arranged corresponding to the light sources, in which the light sources include light sources emitting different quantities of light from each other, and an angle of beam spread of light emitted from each of the lenses is proportional to a quantity of light from a corresponding one of the light sources.

The quantity of light from the light sources may decrease, and the angle of beam spread of light emitted from the lenses may decrease moving away from a center line of the housing in a direction perpendicular to the center line of the housing.

The separation distance between adjacent light sources and the separation distance between adjacent lenses may decrease moving away from the center line of the housing in the direction perpendicular to the center line of the housing.

The quantity of light from the light sources may increase, and the angle of beam spread of light emitted from the lenses may increase moving away from the center line of the housing in the direction perpendicular to the center line of the housing.

The separation distance between adjacent light sources and the separation distance between adjacent lenses may increase moving away from the center line of the housing in the direction perpendicular to the center line of the housing.

The lighting device may further include an optical sheet disposed on the lens array unit.

The lens array unit may further include a connection portion for connecting the lenses.

The light sources may be arranged in a row or in a matrix form having rows and columns.

The connection portion may be made of the same material as the lenses and may be integrally formed with the lenses.

The lighting device may further include a fixing unit disposed on the substrate in order to support the lens array unit.

A lighting device according to a further embodiment includes a housing including a lower plate and a side plate, a light-emitting module including a substrate disposed on the lower plate and first light sources and second light sources disposed on the substrate, each of the second light sources being disposed between adjacent ones of the first light sources, a lens array unit including lenses arranged in alignment with the light sources and a connection portion for connecting the lenses, and an optical sheet disposed on the lens array unit, in which a quantity of light from the first light sources is smaller than a quantity of light from the second light sources, separation distances between the first light sources and the second light sources adjacent to each other are identical to each other, and a size of each of the first lenses is smaller than a size of each of the second lenses.

Advantageous Effects

Embodiments are capable of improving luminance uniformity and color uniformity and of preventing yield reduction.

BEST MODE

Figure 1:
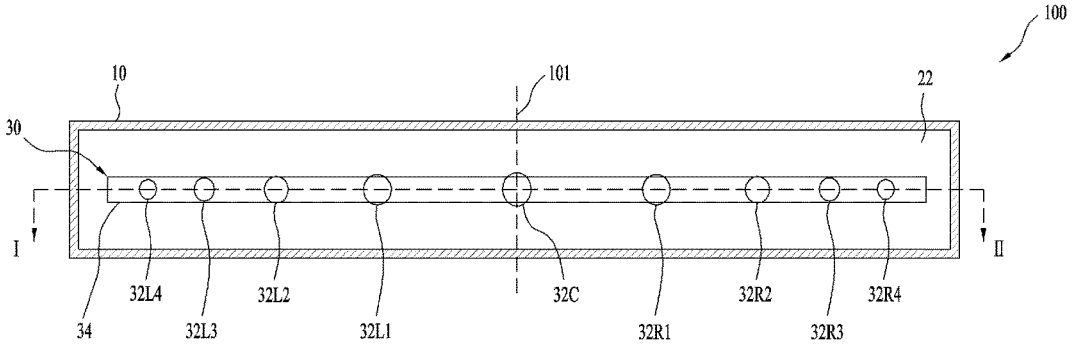
FIG. 1 illustrates a plan view of a lighting device according to an embodiment.

Hereinafter, embodiments will be clearly understood from the attached drawings and the description associated with the embodiments. In the description of the embodiments, it will be understood that when an element, such as a layer (film), a region, a pattern or a structure, is referred to as being "on" or "under" another element, such as a substrate, a layer (film), a region, a pad or a pattern, the term "on" or "under" means that the element can be "directly" on or under another element or can be "indirectly" formed such that an intervening element may also be present. In addition, it will also be understood that criteria of on or under is on the basis of the drawings.

In the drawings, dimensions are exaggerated, omitted or schematically illustrated for description convenience and clarity. In addition, dimensions of constituent elements do not entirely reflect actual dimensions. Wherever possible, the same reference numbers will be used throughout the drawings to refer to the same or like parts. Hereinafter, a lighting device according to an embodiment will be described with reference to the accompanying drawings.

Figure 2:
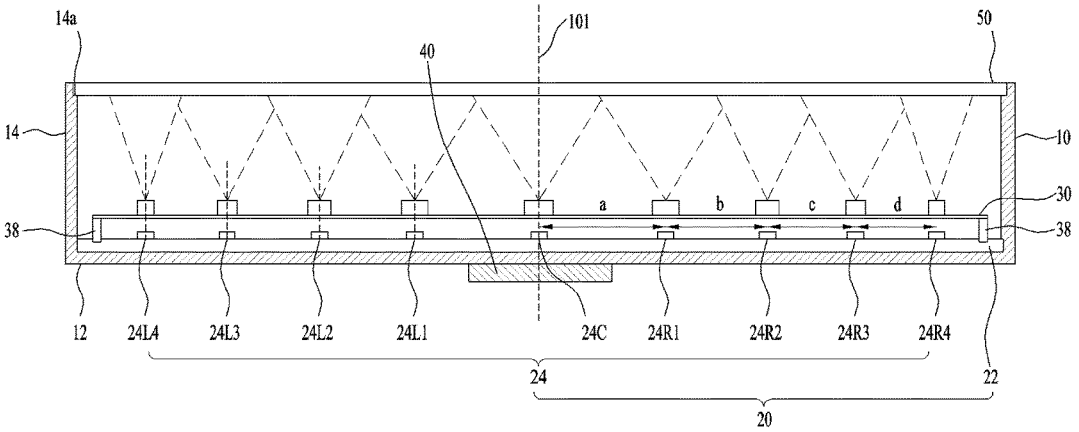
FIG. 2 illustrates a sectional view taken along line I-II in the lighting device depicted in FIG. 1.

FIG. 1 illustrates a plan view of a lighting device 100 according to an embodiment, and FIG. 2 illustrates a sectional view taken along line I-II in the lighting device 100 depicted in FIG. 1.

Referring to FIGS. 1 and 2, a lighting device 100 comprises a housing 10, a light-emitting module 20, a lens array unit (or a lens array bar) 30, a fixing unit 38, a power supply unit 40, and an optical sheet 50.

The light-emitting module 20 and the lens array unit 30 may compose a light source unit.

The housing 10 accommodates the light source unit, which includes the light-emitting module 20 and the lens array unit 30.

Further, the housing 10 may reflect light emitted from the light-emitting module 20.

The housing 10 may include a lower plate 12, on which the light-emitting module 20 is disposed, and a side plate 14, which surrounds the light-emitting module 20. The side plate 14 may be connected to an edge portion of the lower plate 12, and may be inclined at a constant angle relative to the lower plate 12.

Although it is illustrated in FIG. 2 that the angle between the side plate 14 and the lower plate 12 is a right angle, the embodiment is not limited thereto, and the angle between the side plate 14 and the lower plate 12 may be an obtuse angle in another embodiment.

That is, the angle between the lower plate 12 and the side plate 14 of the housing 10 may be larger than or equal to 90° and may be smaller than 180°. As an example, the longitudinal-sectional shape of the housing 10 may be a rectangular shape, a square shape or a trapezoidal shape.

The housing 10 may have a polygonal shape, for example, a quadrangular shape, when viewed from above.

For instance, when viewed from above, the housing 10 may have a rectangular shape in which the horizontal length is longer than the vertical length; however, the embodiment is not limited thereto, and the housing 10 may be formed in various other shapes depending on the application to which the lighting device is applied.

The light-emitting module 20 may include a substrate 22, which is disposed on the lower plate 12 of the housing 10, and a light source array 24, which is disposed on the substrate 22. The light source array 24 may include a plurality of light sources 24C, 24L1 to 24L4 and 24R1 to 24R4, which are disposed on the substrate 22 such that they are spaced apart from each other.

The substrate 22 may be a printed circuit board (PCB), and the plurality of light sources 24C, 24L1 to 24L4 and 24R1 to 24R4 may include light-emitting diodes (LEDs). As an example, each of the light sources 24C, 24L1 to 24L4 and 24R1 to 24R4 may be an LED chip or an LED package; however, the embodiment is not limited thereto.

The plurality of light sources 24C, 24L1 to 24L4 and 24R1 to 24R4 are disposed on the substrate 22. For instance, the plurality of light sources 24C, 24L1 to 24L4 and 24R1 to 24R4 may be arranged in a row while being spaced apart from each other, or may be arranged in a matrix form while being spaced apart from each other on the substrate 22; however, the embodiment is not limited thereto, and the plurality of light sources may be arranged in contact with each other in another embodiment.

Although it is illustrated in FIG. 1 that the plurality of light sources 24C, 24L1 to 24L4 and 24R1 to 24R4 are arranged in a row in the horizontal direction, the plurality of light sources may be arranged in a matrix form, which has a dimension of multiple rows×multiple columns, in another embodiment.

The substrate 22 may include a wiring pattern for the supply of power and the transmission of control signals.

The substrate 22 may be secured to the lower plate 12 of the housing 10 by means of an adhesive member.

Alternatively, at least one of the lower plate 12 and the side plate 14 of the housing 10 may have a recess portion (not shown) therein, into which the substrate 22 of the light-emitting module 20 is inserted, with the result that the substrate 22 may be secured to the housing 10 by being inserted into the recess portion.

At least one of the plurality of light sources 24C, 24L1 to 24L4 and 24R1 to 24R4 may emit a different quantity of light from the others. As an example, each of the plurality of light sources 24C, 24L1 to 24L4 and 24R1 to 24R4 may emit a different quantity of light from the others.

The plurality of light sources 24C, 24L1 to 24L4 and 24R1 to 24R4 may include light sources emitting different quantities of light from each other.

The plurality of light sources 24L1 to 24L4 and 24R1 to 24R4 may be arranged symmetrically with each other on the basis of a reference line 101.

The plurality of light sources 24C, 24L1 to 24L4 and 24R1 to 24R4 may be arranged such that a separation distance between two adjacent light sources is different from a separation distance between two other adjacent light sources.

At least one of the separation distances between the adjacent light sources may be different from the other separation distances. As an example, each of the separation distances between the adjacent light sources may be different from the others.

As an example, the separation distance may be a pitch between two adjacent light sources. Here, the pitch may be a separation distance between the centers of the two adjacent light sources.

The plurality of light sources 24C, 24L1 to 24L4 and 24R1 to 24R4 may be classified into an A-type to an E-type based on the value or the level of quantity of light. The value of quantity of light may be as follows: A-type >B-type >C-type >D-type >E-type.

As an example, when the quantity of light from the A-type is defined as 100%, the quantity of light from the B-type may be 96%, the quantity of light from the C-type may be 90%, the quantity of light from the D-type may be 82%, and the quantity of light from the E-type may be 70%; however, this classification is merely exemplary, and the plurality of light sources 24C, 24L1 to 24L4 and 24R1 to 24R4 may be classified into various other categories depending on the quantity of light.

The plurality of light sources 24C, 24L1 to 24L4 and 24R1 to 24R4 are classified into five types depending on the quantity of light; however, the embodiment is not limited thereto, and the plurality of light sources may be classified into two or more types.

The quantity of light from the light sources, which are disposed on the substrate 22, may increase or decrease in a first direction. The first direction may be a direction that is parallel to the direction in which the light sources are arranged. In the case in which the light sources are arranged in a matrix form, the first direction may be a row direction or a column direction.

Further, the quantity of light from the arranged light sources may increase or decrease in a second direction on the basis of the reference line 101. Here, the second direction may be a lateral direction on the basis of the reference line 101.

In the embodiment in FIG. 2, the quantity of light from the light-emitting element 24C that is aligned with the reference line 101 is the largest, and the quantity of light from the light sources decreases moving away from the reference line 101 in the second direction. In the embodiment in FIG. 7, which will be described later, the quantity of light from the light-emitting element 24C that is aligned with the reference line 101 is the smallest, and the quantity of light from the light sources 24C', 24L1' to 24L4' and 24R1 to 24R4' may increase moving away from the reference line in the second direction.

Further, in the embodiment (24C, 24L1 to 24L4 and 24R1 to 24R4) in FIG. 2, the quantity of light from the light sources may be bilaterally symmetrical on the basis of the reference line 101 in the second direction; however, the embodiment is not limited thereto.

Here, the reference line 101 may be a center line, which extends between the middle of one end of the housing 10 and the middle of the other end of the housing 10. Further, the reference line 101 may be a center line, which extends between the middle of one end of the substrate 22 and the middle of the other end of the substrate 22. As an example, the light source that is located at the center position of the arranged light sources 24C, 24L1 to 24L4 and 24R1 to 24R4 may be aligned with the reference line 101.

The first light source 24C, which is aligned with the reference line 101, may be of an A-type, and may emit the largest quantity of light, and the quantity of light from the light sources may decrease moving away from the reference line 101.

As an example, the quantity of light from the light sources 24C, 24L1 to 24L4 and 24R1 to 24R4 may decrease moving away from the center line of the housing 10 in the direction perpendicular to the center line of the housing 10.

As an example, the B-type light source 24L1, the C-type light source 24L2, the D-type light source 24L3, and the E-type light source 24L4 may be arranged sequentially to the left from the reference line 101 or from the first light source 24C.

The B-type light source 24R1, the C-type light source 24R2, the D-type light source 24R3, and the E-type light source 24R4 may be arranged sequentially to the right from the reference line 101 or from the first light source 24C.

Further, the separation distances between the adjacent light sources, for example, the pitches a, b, c and d, may decrease (a>b>c>d) moving away from the reference line 101 or the first light source 24C in the second direction.

The lens array unit (or the lens array bar) 30 may include a plurality of lenses 32C, 32L1 to 32L4 and 32R1 to 32R4, which are arranged so as to be spaced apart from each other, and a connection portion 34 for connecting the plurality of lenses 32C, 32L1 to 32L4 and 32R1 to 32R4.

The plurality of lenses 32C, 32L1 to 32L4 and 32R1 to 32R4 may be formed to protrude from the top surface of the connection portion 34 in the vertical direction, for example, in the upward direction.

Each of the plurality of lenses 32C, 32L1 to 32L4 and 32R1 to 32R4 may be arranged so as to correspond to or to be aligned with a respective one of the plurality of light sources 24C, 24L1 to 24L4 and 24R1 to 24R4.

As an example, the center of each of the plurality of lenses 32C, 32L1 to 32L4 and 32R1 to 32R4 may be aligned with the center of a corresponding one of the plurality of light sources 24C, 24L1 to 24L4 and 24R1 to 24R4 in the vertical direction. Here, the vertical direction may be a direction that is perpendicular to the top surface of the substrate 22 and is oriented toward the lens array unit 30 from the substrate 22.

The separation distance between two adjacent lenses may be equal to the separation distance between two adjacent light sources that correspond to the two adjacent lenses.

The separation distance between two adjacent lenses may decrease moving away from the reference line 101 in the second direction. Further, the separation distance between two adjacent lenses may be bilaterally symmetrical on the basis of the reference line 101.

As an example, the separation distance between two adjacent light sources and the separation distance between two adjacent lenses may decrease moving away from the center line of the housing 10 in the direction perpendicular to the center line of the housing 10.

The size of each of the plurality of lenses 32C, 32L1 to 32L4 and 32R1 to 32R4 may be proportional to the quantity of light from a corresponding one of the light sources 24C, 24L1 to 24L4 and 24R1 to 24R4.

As an example, the greater the quantity of light from the light source, the larger the size of the corresponding lens, and, on the other hand, the lower the quantity of light from the light source, the smaller the size of the corresponding lens.

The sizes of the lenses 32C, 32L1 to 32L4 and 32R1 to 32R4 may decrease moving away from the center line of the housing 10 in the direction perpendicular to the center line of the housing 10.

The first lens 32C, which is aligned with the reference line 101, may have the largest size, and the sizes of the arranged lenses may decrease moving away from the first lens 32C. Here, the size of the lens may be the diameter of the lens.

As an example, the second lens 32L1, the third lens 32L2, the fourth lens 32L3, and the fifth lens 32L4 may be arranged sequentially to the left from the reference line 101 or from the first lens 32C, and the sizes of the lenses may be as follows: first lens 32C >second lens 32L1 >third lens 32L2 >fourth lens 32L3 >fifth lens 32L4.

The second lens 32R1, the third lens 32R2, the fourth lens 32R3, and the fifth lens 32R4 may be arranged sequentially to the right from the reference line 101 or from the first lens 32C, and the sizes of the lenses may be as follows: first lens 32C >second lens 32R1 >third lens 32R2 >fourth lens 32R3 >fifth lens 32R4.

The light beams emitted from the plurality of lenses 32C, 32L1 to 32L4 and 32R1 to 32R4 may have luminance distributions having different sizes in the optical sheet 50.

The angle of beam spread of the light emitted from each of the plurality of lenses 32C, 32L1 to 32L4 and 32R1 to 32R4 may be proportional to the quantity of light from a corresponding one of the light sources 24C, 24L1 to 24L4 and 24R1 to 24R4.

The quantity of light from the light sources 24C, 24L1 to 24L4 and 24R1 to 24R4 may decrease, and the angle of beam spread of the light emitted from the corresponding lenses 32C, 32L1 to 32L4 and 32R1 to 32R4 may decrease moving away from the center line of the housing 10 in the direction perpendicular to the center line of the housing 10.

As an example, the quantity of light from the light sources 24C, 24L1 to 24L4 and 24R1 to 24R4 may decrease, and the angle of beam spread of the light emitted from the corresponding lenses 32C, 32L1 to 32L4 and 32R1 to 32R4 may decrease moving away from the reference line 101 in the second direction.

Figure 3:
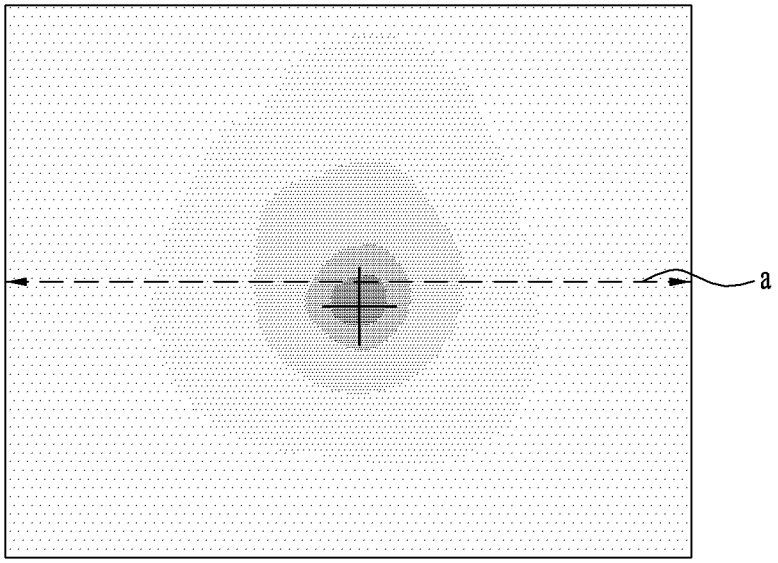
FIG. 3 illustrates luminance distribution of a lens corresponding to an A-type light source.
Figure 4:
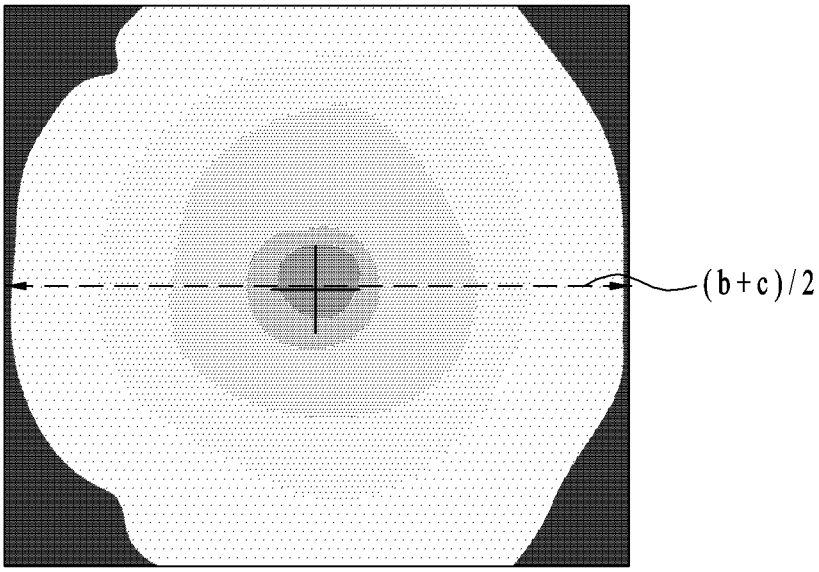
FIG. 4 illustrates luminance distribution of a lens corresponding to a C-type light source.
Figure 5:
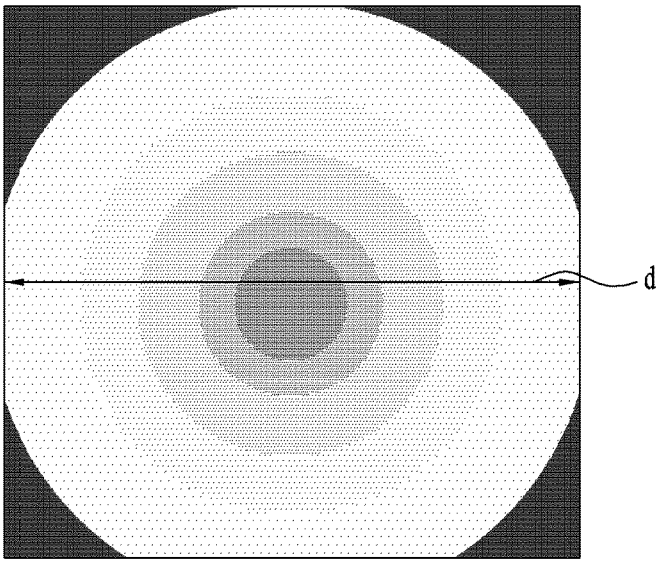
FIG. 5 illustrates luminance distribution of a lens corresponding to an E-type light source.

FIG. 3 illustrates the luminance distribution of a lens corresponding to the A-type light source, FIG. 4 illustrates the luminance distribution of a lens corresponding to the C-type light source, and FIG. 5 illustrates the luminance distribution of a lens corresponding to the E-type light source.

The light emitted from the first lens 32C, which corresponds to the first light source 24C, which is of an A-type, may have the largest luminance distribution, and the size of the luminance distribution may decrease moving away from the reference line 101 or the first lens 32C.

Referring to FIG. 3, as an example, the diameter of the luminance distribution of the light emitted from the first lens 32C, which corresponds to the first light source 24C, which is of an A-type, may be equal to a first separation distance a.

The first separation distance a may be a separation distance between the first light source 24C and the second light source 24L1 and 24R1 or a separation distance between the first lens 32C and the second lens 34L1 and 34R1.

Referring to FIG. 4, as an example, the diameter of the luminance distribution of the light emitted from the third lens 32L1 and 32R1, which corresponds to the third light source 24L2 and 24R2, which is of a C-type, may be equal to a value obtained by dividing the sum of a second separation distance b and a third separation distance c by 2 ((b+c)/2).

The second separation distance b may be a separation distance between the second light source 24L1 and 24R1 and the third light source 24L2 and 24R2 or a separation distance between the second lens 34L1 and 34R1 and the third lens 34L2 and 34R2.

The third separation distance c may be a separation distance between the third light source 24L2 and 24R2 and the fourth light source 24L3 and 24R3 or a separation distance between the third lens 34L2 and 34R2 and the fourth lens 34L3 and 34R3.

Referring to FIG. 5, the diameter of the luminance distribution of the light emitted from the fifth lens 32L4 and 32R4, which corresponds to the fifth light source 24L4 and 24R4, which is of an E-type, may be equal to a fourth separation distance d.

The fourth separation distance d may be a separation distance between the fourth light source 24L3 and 24R3 and the fifth light source 24L4 and 24R4 or a separation distance between the fourth lens 34L3 and 34R3 and the fifth lens 34L4 and 34R4.

It can be seen that the diameter of the luminance distribution of the light emitted from the light sources decreases moving away from the reference line 101 or the first lens 32C.

The connection portion 34 may be configured as a plate, which is connected with the plurality of lenses 32C, 32L1 to 32L4 and 32R1 to 32R4. The connection portion 34 may be made of the same material as the plurality of lenses 32C, 32L1 to 32L4 and 32R1 to 32R4, and may be integrally formed with the lenses; however, the embodiment is not limited thereto.

The fixing unit 38 may be disposed on the substrate 22 in order to secure the lens array unit 30 to the substrate 22, and may support the lens array unit 30. As an example, the fixing unit 38 may secure the connection portion 340 of the lens array unit 30 to the substrate 220.

As an example, one end of the fixing unit 38 may be connected to the bottom surface of the connection portion 340 of the lens array unit 30, and the other end of the fixing unit 38 may be connected to the top surface of the substrate 22 using a fastening means such as a bolt, a screw, an adhesive agent, etc.

The fixing unit 38 may be made of the same material as the lens array unit 30 and may be integrally formed with the lens array unit 30; however, the embodiment is not limited thereto, and the fixing unit 38 may be made of a material different from that of the lens array unit 30, and may be formed separately from the lens array unit 30.

The power supply unit 40 supplies power to the light-emitting module 20 via a connector (not shown). As an example, the power supply unit 40 may convert commonly-used alternating-current power (AC 110V or 220V) into direct-current voltage (e.g. DC 3.3V), which is LED driving power, and may supply the converted direct-current voltage to the light-emitting module 20.

The optical sheet 50 may be disposed on the lens array unit 30, and may function to diffuse the light emitted from the lens array unit 30 by refraction and scattering or to disperse the light in a constant direction.

The optical sheet 50 may be supported by the housing 10.

As an example, the upper end of the side plate 14 of the housing 10 may be provided with a stepped portion 14*a*, and the optical sheet 50 may be supported by the stepped portion 14*a*.

The optical sheet 50 may include at least one of a diffusion sheet, a prism sheet and a micro lens array.

As an example, the diffusion sheet may be formed of a polyester or polycarbonate-based material, and may increase the projection angle of light by refraction and scattering.

The prism sheet may include at least one of a first prism sheet and a second prism sheet.

As an example, each of the first prism sheet and the second prism sheet may be formed by applying a light-transmitting and elastic polymer to a surface of a support film, and the polymer may have a prism layer in which a plurality of 3D structures is repeatedly formed. Here, the plurality of structures may be provided as a stripe pattern in which ridges and valleys are repeatedly formed. In addition, the direction of the ridges and valleys in the second prism sheet may be perpendicular to the direction of the ridges and valleys in the first prism sheet.

Although the light sources are manufactured through the same process, there may be a difference in the values of quantity of light from the light sources, and in the case in which light sources emitting different quantities of light from each other are used for flat lighting devices or backlight units, the luminance uniformity and the color uniformity may be degraded, and yield reduction may even occur because the light sources cannot be used when there is a large difference in the values of quantity of light.

Meanwhile, according to the embodiment 100, the sizes of the lenses are proportional to the quantity of light from the light sources 24C, 24L1 to 24L4 and 24R1 to 24R4, and the separation distance between two adjacent light sources and the separation distance between two adjacent lenses are adjusted in consideration of the quantity of light, thereby improving the luminance uniformity and the color uniformity and preventing yield reduction.

Figure 6:
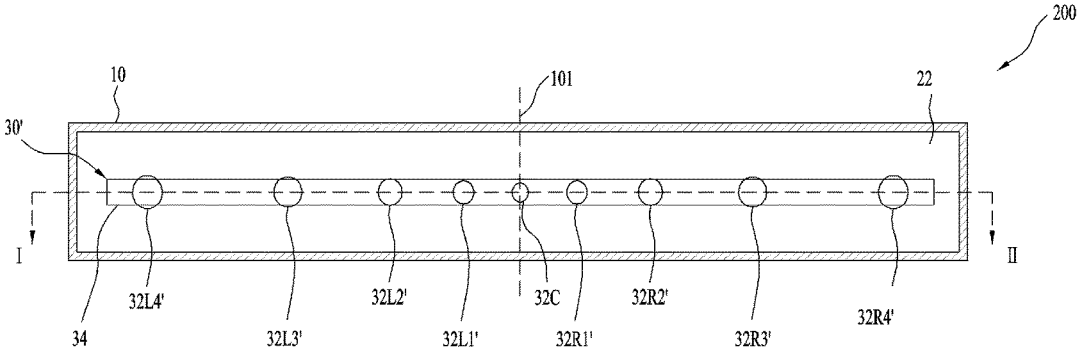
FIG. 6 illustrates a plan view of a lighting device according to another embodiment.
Figures 7, 8:
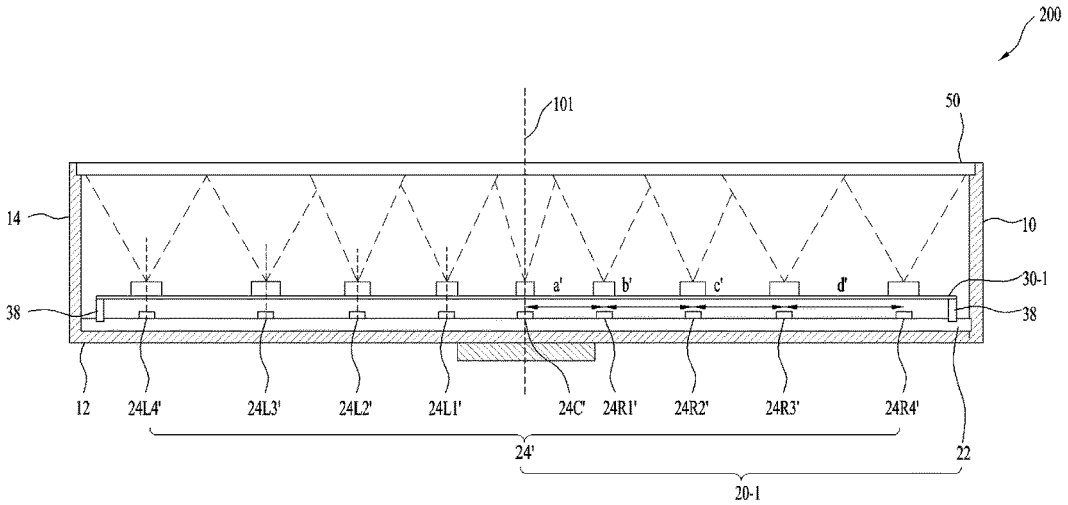
FIG. 7 illustrates a sectional view taken along line I-II in the lighting device depicted in FIG. 6.
FIG. 8 illustrates the arrangement of light sources depending on the quantity of light according to another embodiment.

FIG. 6 illustrates a plan view of a lighting device 200 according to another embodiment, and FIG. 7 illustrates a sectional view taken along line I-II in the lighting device 200 depicted in FIG. 6. Reference numerals the same as those in FIGS. 1 and 2 designate the same components, and an explanation thereof will be made briefly or omitted.

Referring to FIGS. 6 and 7, a lighting device 200 comprises a housing 10, a light-emitting module 20-1, a lens array unit 30-1, a fixing unit 38, a power supply unit 40, and an optical sheet 50.

The light-emitting module 20-1 may include a substrate 22, and a light source array 24', which includes a plurality of light sources 24-1, 24C', 24L1' to 24L4' and 24R1 to 24R4', which are disposed on the substrate while being spaced apart from each other.

The lens array unit 30-1 may include a plurality of lenses 32C', 32L1' to 32L4' and 32R1' to 32R4', which are arranged so as to be spaced apart from each other, and a connection portion 34 for connecting the plurality of lenses 32C', 32L1' to 32L4' and 32R1' to 32R4'.

The arrangement of the plurality of light sources 24C', 24L1' to 24L4' and 24R1 to 24R4', which are classified into an A-type to an E-type based on the quantity of light, on the substrate 22 and the arrangement of the lenses 32C', 32L1' to 32L4' and 32R1' to 32R4', corresponding to the plurality of light sources 24C', 24L1' to 24L4' and 24R1 to 24R4' in the embodiment 200, are different from those in the embodiment 100 depicted in FIGS. 1 and 2.

The quantity of light from the light sources 24C', 24L1' to 24L4' and 24R1 to 24R4' may increase moving away from a center line of the housing 10 in the direction perpendicular to the center line of the housing 10. Here, the center line may be the same as that described above with reference to FIGS. 1 and 2.

The first light source 24C', which is aligned with the reference line 101, may be of an E-type and may emit the smallest quantity of light, and the quantity of light from the light sources 24L1' to 24L4' and 24R1 to 24R4' may increase moving away from the reference line 101 or the first light source 24C'.

As an example, the D-type light source 24L1', the C-type light source 24L2', the B-type light source 24L3', and the A-type light source 24L4' may be arranged sequentially to the left from the reference line 101 or from the first light source 24C'.

The D-type light source 24R1', the C-type light source 24R2', the B-type light source 24R3', and the A-type light source 24R4' may be arranged sequentially to the right from the reference line 101 or from the first light source 24C'.

Further, the separation distances between the adjacent light sources, for example, the pitches a', b', c' and d', may increase (a'<b'<c'<d') moving away from the reference line 101 or the first light source 24C'.

Each of the plurality of lenses 32C', 32L1' to 32L4' and 32R1' to 32R4' may be arranged so as to correspond to or to be aligned with a respective one of the plurality of light sources 24C', 24L1' to 24L4' and 24R1' to 24R4'.

As an example, the center of each of the plurality of lenses 32C', 32L1' to 32L4' and 32R1' to 32R4' may be aligned with the center of a corresponding one of the plurality of light sources 24C', 24L1' to 24L4' and 24R1' to 24R4' in the vertical direction. Here, the vertical direction may be a direction that is perpendicular to the top surface of the substrate 22 and is oriented toward the lens array unit 30 from the substrate 22.

The separation distance between two adjacent lenses may be equal to the separation distance between two adjacent light sources that correspond to the two adjacent lenses.

The separation distance between two adjacent lenses may increase moving away from the reference line 101 in the second direction.

The separation distance between two adjacent light sources and the separation distance between two adjacent lenses may increase moving away from the center line of the housing 10 in the direction perpendicular to the center line of the housing 10.

The size of each of the plurality of lenses 32C', 32L1' to 32L4' and 32R1' to 32R4' may be proportional to the quantity of light from a corresponding one of the light sources 24C', 24L1' to 24L4' and 24R1' to 24R4'.

The sizes of the lenses 32C', 32L1' to 32L4' and 32R1' to 32R4' may increase moving away from the center line of the housing 10 in the direction perpendicular to the center line of the housing 10.

The first lens 32C', which is aligned with the reference line 101, may have the smallest size, and the sizes of the arranged lenses 32L1' to 32L4' and 32R1' to 32R4' may increase moving away from the reference line 101 or the first lens 32C'.

As an example, the second lens 32L1', the third lens 32L2', the fourth lens 32L3', and the fifth lens 32L4' may be arranged sequentially to the left from the reference line 101 or from the first lens 32C', and the sizes of the lenses may be as follows: first lens 32C'<second lens 32L1'<third lens 32L2'<fourth lens 32L3'<fifth lens 32L4'.

The second lens 32R1', the third lens 32R2', the fourth lens 32R3', and the fifth lens 32R4' may be arranged sequentially to the right from the reference line 101 or from the first lens 32C', and the sizes of the lenses may be as follows: first lens 32C'<second lens 32R1'<third lens 32R2'<fourth lens 32R3'<fifth lens 32R4'.

The light beams emitted from the plurality of lenses 32C', 32L1' to 32L4' and 32R1' to 32R4' may have luminance distributions having different sizes in the optical sheet 50.

As an example, the light emitted from the first lens 32C', which corresponds to the first light source 24C', which is of an E-type, may have the smallest luminance distribution, and the size of the luminance distribution may increase moving away from the first lens 32C'.

Further, as an example, the diameter of the luminance distribution of the light emitted from the first lens 32C', which corresponds to the first light source 24C', which is of an E-type, may be equal to a separation distance a' between the first light source 24C' and the second light source 24L1' and 24R1' or a separation distance between the first lens 32C' and the second lens 34L1' and 34R1'.

Further, as an example, the diameter of the luminance distribution of the light emitted from the third lens 32L2' and 32R2', which corresponds to the third light source 24L2' and 24R2', which is of a C-type, may be equal to a value obtained by dividing the sum of a separation distance b' and a separation distance c' by 2' ((b'+c')/2).

The separation distance b' may be a separation distance between the second light source 24L1' and 24R1' and the third light source 24L2' and 24R2' or a separation distance between the second lens 34L1' and 34R1' and the third lens 34L2' and 34R2'.

The separation distance c may be a separation distance between the third light source 24L2' and 24R2' and the fourth light source 24L3' and 24R3' or a separation distance between the third lens 34L2' and 34R2' and the fourth lens 34L3' and 34R3'.

The diameter of the luminance distribution of the light emitted from the fifth lens 32L4' and 32R4', which corresponds to the fifth light source 24L4' and 24R4', which is an A-type, may be equal to a separation distance d'.

The separation distance d' may be a separation distance between the fourth light source 24L3' and 24R3' and the fifth light source 24L4' and 24R4' or a separation distance between the fourth lens 34L3' and 34R3' and the fifth lens 34L4' and 34R4'.

The angle of beam spread of the light emitted from each of the plurality of lenses 32C', 32L1' to 32L4' and 32R1' to 32R4' may be proportional to the quantity of light from a corresponding one of the light sources 24C', 24L1' to 24L4' and 24R1' to 24R4'.

The quantity of light from the light sources 24C', 24L1' to 24L4' and 24R1' to 24R4' may increase, and the angle of beam spread of the light emitted from the corresponding lenses 32C', 32L1' to 32L4' and 32R1' to 32R4' may increase moving away from the center line of the housing 10 in the direction perpendicular to the center line of the housing 10.

As an example, the quantity of light from the light sources 24C', 24L1' to 24L4' and 24R1' to 24R4' may increase, and the angle of beam spread of the light emitted from the corresponding lenses 32C', 32L1' to 32L4' and 32R1' to 32R4' may increase moving away from the reference line 101 in the second direction.

According to the embodiment 200, the sizes of the lenses 32C', 32L1' to 32L4' and 32R1' to 32R4' are proportional to the quantity of light from the light sources 24C', 24L1' to 24L4' and 24R1' to 24R4', and the separation distance between two adjacent light sources and the separation distance between two adjacent lenses are adjusted in consideration of the quantity of light, thereby improving the luminance uniformity and the color uniformity and preventing yield reduction.

FIG. 8 illustrates the arrangement of the light sources depending on the quantity of light according to another embodiment.

Referring to FIG. 8, another embodiment may comprise a light-emitting module, which includes a substrate 22 and first light sources 24*a*1 to 24*a*4 and second light sources 24*b*1 to 24*b*3 disposed on the substrate 22 while being spaced apart from each other.

Each of the second light sources 24*b*1 to 24*b*3 may be disposed between two adjacent corresponding first light sources 24*a*1 and 24*a*2, 24*a*2 and 24*a*3, and 24*a*3 and 24*a*4.

The first light sources 24*a*1 to 24*a*4 may emit the same quantity of light as each other, and the second light sources 24*b*1 to 24*b*3 may emit the same quantity of light as each other. Further, the quantity of light from the first light sources 24*a*1 to 24*a*4 may be different from the quantity of light from the second light sources 24*b*1 to 24*b*3.

As an example, each of the first light sources 24*a*1 to 24*a*4 may be a B-type light source, and each of the second light sources 24*b*1 to 24*b*3 may be an A-type light source. That is, the quantity of light from each of the first light sources 24*a*1 to 24*a*4 may be smaller than the quantity of light from each of the second light sources 24*b*1 to 24*b*3.

Another embodiment may include first lenses 32*a*1 to 32*a*4, which correspond to the first light sources 24*a*1 to 24*a*4, and second lenses 32*b*1 to 32*b*3, which correspond to the second light sources 24*b*1 to 24*b*3.

The separation distances between the first light sources and the second light sources adjacent to each other may be the same as each other, and the separation distances between the first lenses and the second lenses adjacent to each other may also be the same as each other.

The size R1 of each of the first lenses 32*a*1 to 32*a*4 may be smaller than the size R2 of each of the second lenses 32*b*1 to 32*b*3 (R1<R2).

Figure 9:
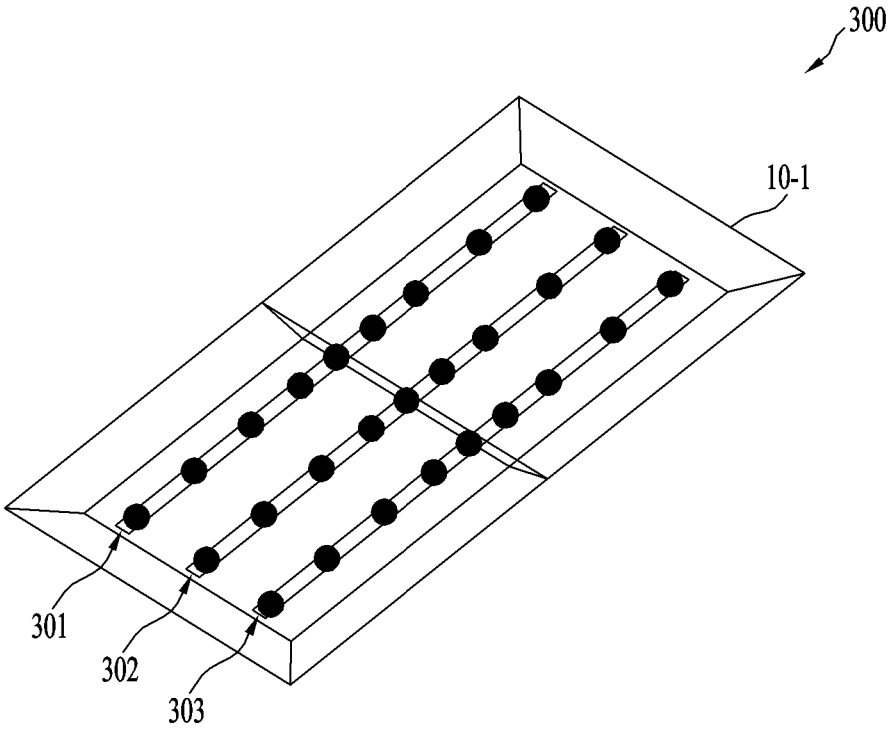
FIG. 9 illustrates a lighting device according to another embodiment.

FIG. 9 illustrates a lighting device 300 according to another embodiment.

Referring to FIG. 9, a lighting device 300 may comprise a housing 10-1, a plurality of light source units 301 to 303, a power supply unit (not shown), and an optical sheet (not shown). Although not illustrated in FIG. 9, the power supply unit and the optical sheet may be the same as those described above with reference to FIGS. 1 and 2.

The embodiment illustrated in FIGS. 1 and 2 includes a single light source unit 20 and 30; however, the embodiment 300 illustrated in FIG. 9 includes a plurality of light source units 301 to 303.

Each of the plurality of light source units 301 to 303 may be embodied as any one of the light source units 24 and 24', which are included in the embodiments in FIGS. 1, 7 and 8.

The embodiment illustrated in FIG. 9 may be used for flat lighting devices or backlight units.

Figure 10:
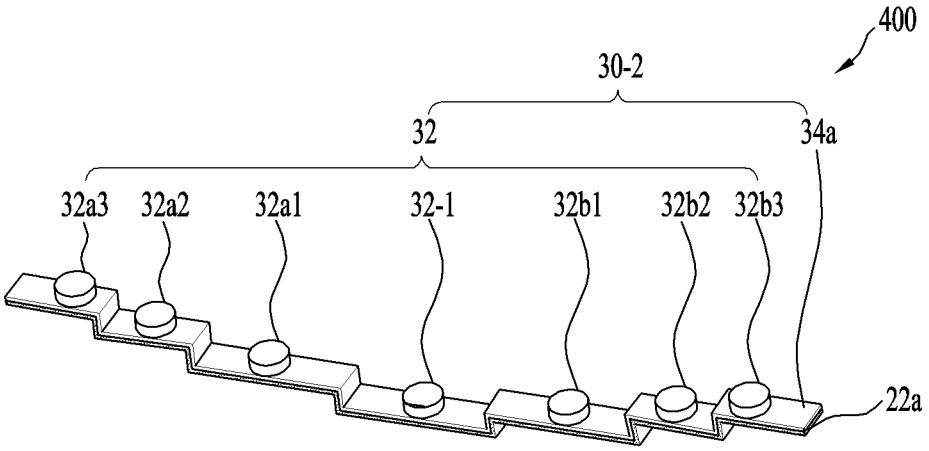
FIG. 10 illustrates a lighting device according to another embodiment.

FIG. 10 illustrates a lighting device 400 according to another embodiment.

Referring to FIG. 10, a lighting device 400 comprises a light-emitting module, which includes a substrate 22*a* and light sources (not shown) disposed on the substrate 22*a*, and a lens array unit 30-2, which is disposed on the light-emitting module. The lens array unit 30-2 may include a plurality of lenses 32-1, 32*a*1 to 32*a*3 and 32*b*1 to 32*b*3, which are arranged so as to be spaced apart from each other, and a connection portion 34 for connecting the plurality of lenses 32-1, 32*a*1 to 32*a*3 and 32*b*1 to 32*b*3.

When compared to FIGS. 1 and 2, the embodiment may have a structure in which the substrate 22*a* of the light-emitting module and the connection portion 34 of the lens array unit 30-2 are formed to have stepped portions so as to correspond to the shape of the application in which the lighting device is disposed.

The lighting device 400 depicted in FIG. 10 may be used for headlamps for vehicles or curved display apparatuses.

As described above with reference to FIGS. 2, 7 and 8, the values of quantity of light from the light sources may be different from each other, and the separation distances between the light sources may be different from each other based on the different values of the quantity of light.

The sizes of the lenses 32-1, 32*a*1 to 32*a*3 and 32*b*1 to 32*b*3, which correspond to the respective light sources, may be different from each other. Each of the lenses 32-1, 32*a*1 to 32*a*3 and 32*b*1 to 32*b*3 may be arranged so as to correspond to or to be aligned with a respective one of the light sources. The size of each of the lenses 32-1, 32*a*1 to 32*a*3 and 32*b*1 to 32*b*3 may be proportional to the quantity of light from a corresponding one of the light sources.

The separation distance between the lenses, the separation distance between the light sources, the sizes of the lenses, and the quantity of light from the light sources, which have been described above with reference to FIGS. 2 and 7, may be identically applied to the embodiment illustrated in FIG. 10. The lighting device 400 may further comprise a housing, a power supply unit, and an optical sheet, which have been described above with reference to FIGS. 1 and 2.

Figure 11:
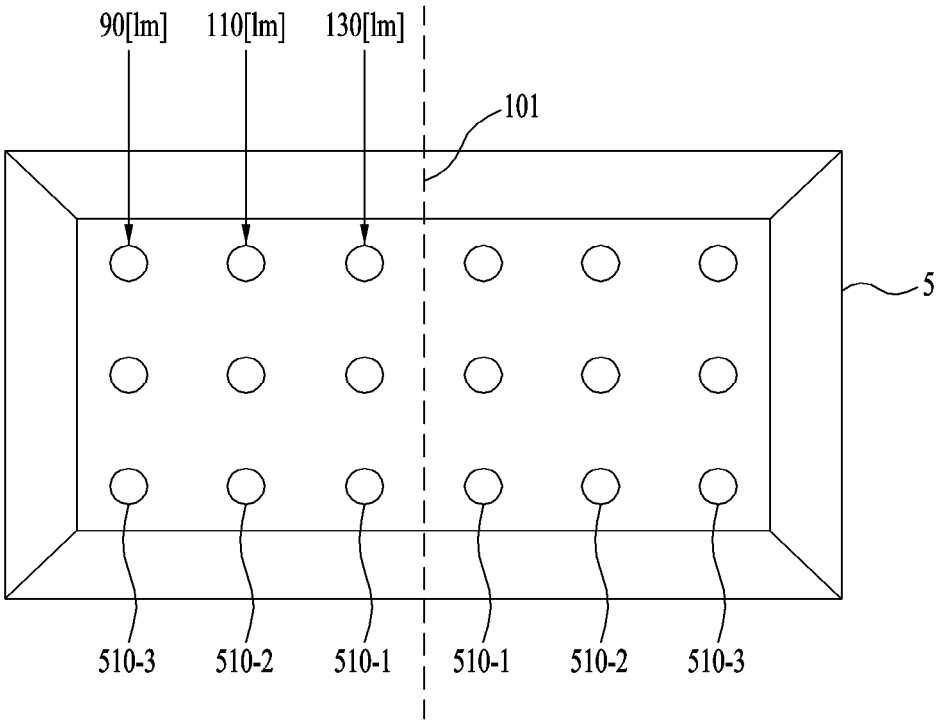
FIG. 11 illustrates the arrangement of light sources and lenses and the sizes of the lenses in a lighting device according to a comparative example.
Figure 12:
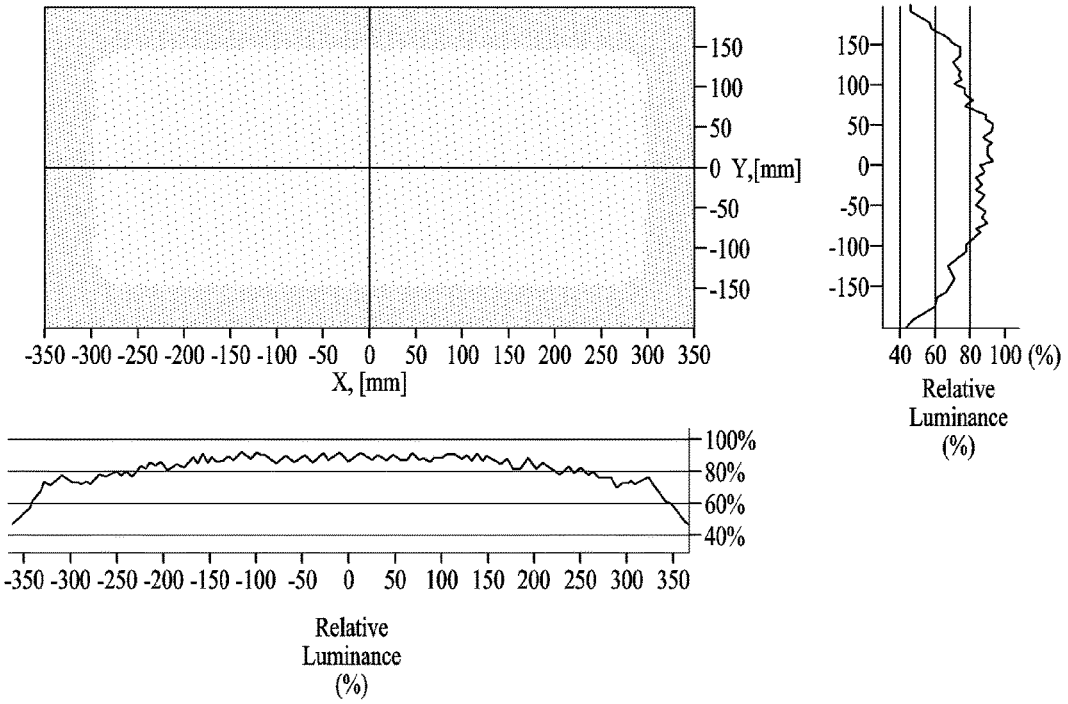
FIG. 12 illustrates luminance distribution of the lighting device depicted in FIG. 11.

FIG. 11 illustrates the arrangement of light sources and lenses and the sizes of the lenses in a lighting device according to a comparative example, and FIG. 12 illustrates the luminance distribution of the lighting device depicted in FIG. 11.

Referring to FIGS. 11 and 12, in the comparative example, light sources (not shown) and lenses 510-1 to 510-3 aligned with the light sources may be arranged in a matrix form, which includes rows and columns.

The quantity of light from the light sources may decrease moving away from the reference line 101 in the horizontal direction. As an example, the quantity of light from the first light source, which is the closest to the center line 101, may be 130 [lm], the quantity of light from the third light source, which is the farthest from the reference line 101, may be 90 [lm], and the quantity of light from the second light source, which is disposed between the first light source and the third light source, may be 110 [lm].

The separation distances between the adjacent light sources may be the same as each other, and the separation distances between the adjacent lenses may be the same as each other. Further, the sizes of the lenses may all be the same regardless of the quantity of light from the light sources.

It can be seen from FIG. 12 that the luminance uniformity of the lighting device depicted in FIG. 11 is about 75%.

Figure 13:
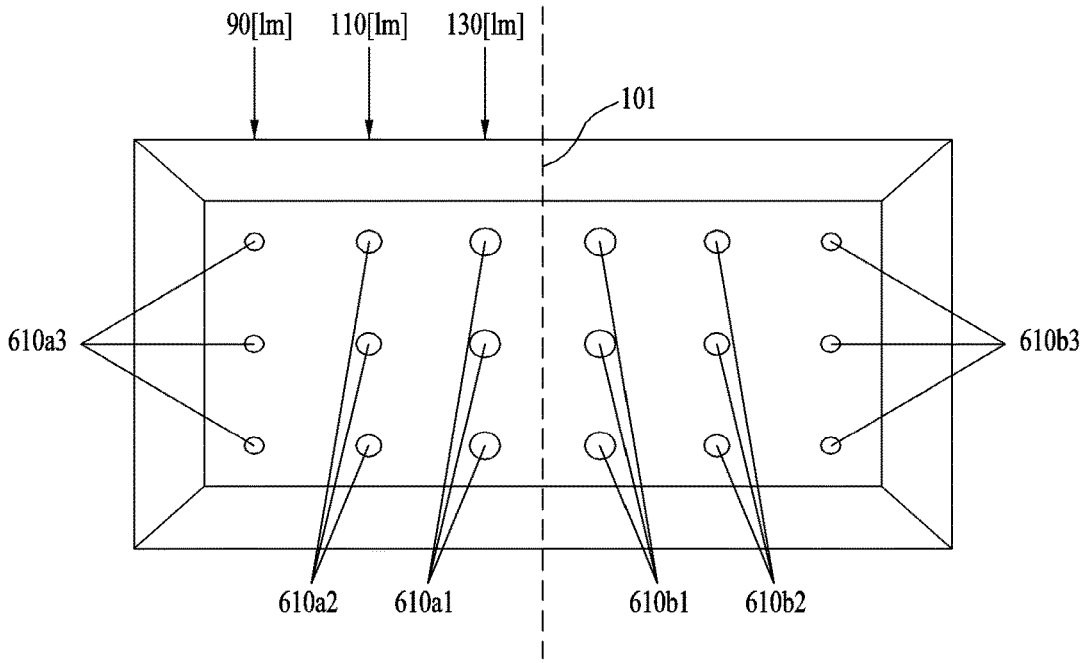
FIG. 13 illustrates the arrangement of light sources and lenses and the sizes of the lenses in the lighting device according to the embodiment.
Figure 14:
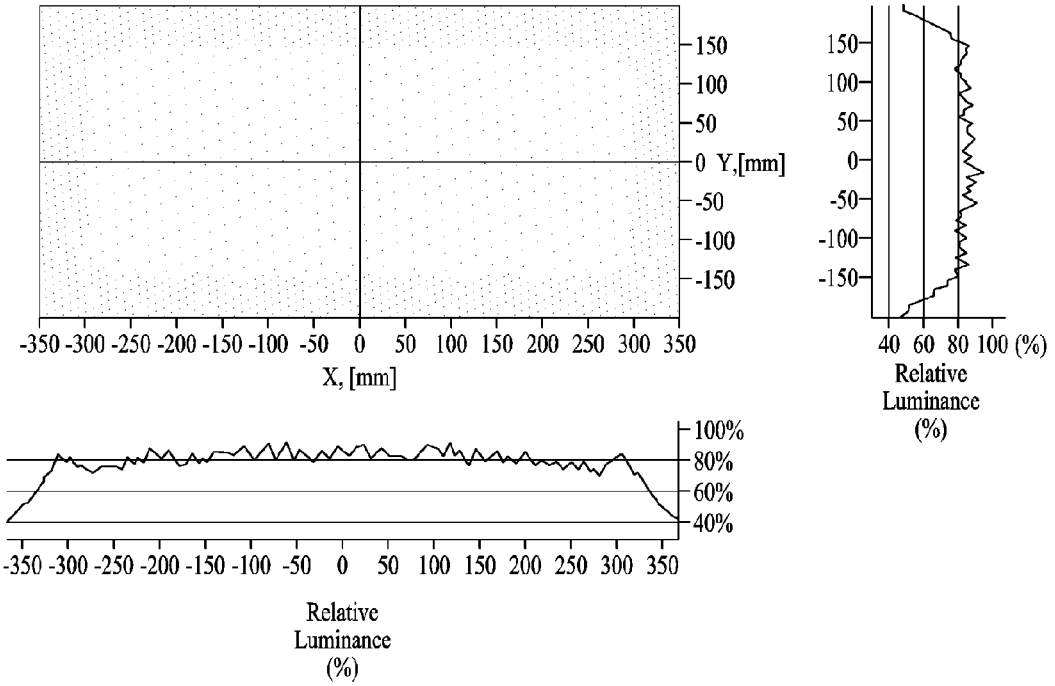
FIG. 14 illustrates luminance distribution of the lighting device depicted in FIG. 13.

FIG. 13 illustrates the arrangement of light sources and lenses and the sizes of the lenses in the lighting device according to the embodiment, and FIG. 14 illustrates the luminance distribution of the lighting device depicted in FIG. 13.

The embodiment illustrated in FIG. 13 may have a configuration similar to that of the lighting device 400 depicted in FIG. 9. Light sources (not shown) and lenses 610*a*1 to 610*a*3 and 610*b*1 to 610*b*3 aligned with the light sources, which are included in the lighting device depicted in FIG. 13, may be arranged in a matrix form, which includes rows and columns.

The quantity of light from the light sources may decrease moving away from the reference line 101 in the horizontal direction. As an example, the quantity of light from the first light source, which is the closest to the reference line 101, may be 130 [lm], the quantity of light from the third light source, which is the farthest from the reference line 101, may be 90 [lm], and the quantity of light from the second light source, which is disposed between the first light source and the third light source, may be 110 [lm].

The separation distances between the adjacent light sources may be the same as each other, and the separation distances between the adjacent lenses may be the same as each other.

The difference from the comparative example is that the sizes of the lenses 610*a*1 to 610*a*3 and 610*b*1 to 610*b*3 depicted in FIG. 13 may be different from each other in consideration of the quantity of light from the light sources.

As an example, the sizes of the lenses 610*a*1 to 610*a*3 and 610*b*1 to 610*b*3 may decrease moving away from the reference line 101 in the horizontal direction. Here, the horizontal direction may be the direction perpendicular to the reference line 101.

It can be seen from FIG. 14 that the luminance uniformity of the lighting device depicted in FIG. 13 is about 90%.

In the comparative example, while the quantity of light from the light sources decreases moving away from the reference line 101 in the horizontal direction, the lenses 510-1, 510-2 and 510-3 have the same size, which causes a lack of quantity of light in the edge portion of the lighting device and degraded luminance uniformity of the lighting device.

Meanwhile, according to the embodiment, the sizes of the lenses 610*a*1 to 610*a*3 and 610*b*1 to 610*b*3 decrease moving away from the reference line 101 in the horizontal direction in consideration of the configuration in which the quantity of light from the light sources decreases moving away from the reference line 101 in the horizontal direction, thereby improving the luminance uniformity of the lighting device.

Features, structures and effects and the like described in association with the embodiments above are incorporated into at least one embodiment of the present disclosure, but are not limited only to one embodiment. Furthermore, features, structures and effects and the like exemplified in association with respective embodiments can be implemented in other embodiments through combination or modification by those skilled in the art. Therefore, contents related to such combinations and modifications should be construed as falling within the scope of the present disclosure.

INDUSTRIAL APPLICABILITY

The embodiments may be used for lighting devices.

The invention claimed is:

1. A lighting device comprising:

a housing including a lower plate and a side plate;

a light-emitting module including a substrate disposed on the lower plate and light sources disposed on the substrate; and a lens array unit including lenses arranged corresponding to the light sources, wherein sizes of the lenses are proportional to a quantity of light from the light sources, the quantity of light from the light sources decreases moving away from a center line of the housing in a direction perpendicular to the center line of the housing, wherein sizes of the lenses decrease moving away from the center line of the housing in the direction perpendicular to the center line of the housing, and wherein a separation distance between adjacent light sources and a separation distance between adjacent lenses decrease moving away from the center line of the housing in the direction perpendicular to the center line of the housing.

2. The lighting device according to claim 1, wherein separation distances between adjacent light sources are different from each other.

3. The lighting device according to claim 1, wherein a center of each of the lenses is aligned with a center of a corresponding one of the light sources.

4. The lighting device according to claim 1, wherein the angle of beam spread of light emitted from the lenses decreases moving away from a center line of the housing in a direction perpendicular to the center line of the housing.

5. The lighting device according to claim 1, further comprising:

an optical sheet disposed on the lens array unit.

6. The lighting device according to claim 1, wherein the lens array unit further includes a connection portion for connecting the lenses.

7. The lighting device according to claim 6, wherein the connection portion is made of a same material as the lenses and is integrally formed with the lenses.

8. The lighting device according to claim 1, wherein the light sources are arranged in a row or in a matrix form having rows and columns.

9. The lighting device according to claim 1, further comprising:

a fixing unit disposed on the substrate in order to support the lens array unit.

10. The lighting device according to claim 1, wherein the size of the lens is a diameter of the lens.

11. A lighting device comprising:

a housing including a lower plate and a side plate;

a light-emitting module including a substrate disposed on the lower plate and light sources disposed on the substrate; and a lens array unit including lenses arranged corresponding to the light sources, wherein the quantity of light from the light sources increases moving away from a center line of the housing in a direction perpendicular to the center line of the housing, wherein sizes of the lenses increase moving away from the center line of the housing in the direction perpendicular to the center line of the housing, and wherein a separation distance between adjacent light sources and a separation distance between adjacent lenses increase moving away from the center line of the housing in the direction perpendicular to the center line of the housing.

12. The lighting device according to claim 11, wherein the angle of beam spread of light emitted from the lenses increases moving away from a center line of the housing in a direction perpendicular to the center line of the housing.

13. The lighting device according to claim 11, further comprising:

an optical sheet disposed on the lens array unit.

14. The lighting device according to claim 11, wherein the lens array unit further includes a connection portion for connecting the lenses.

15. The lighting device according to claim 11, wherein the light sources are arranged in a row or in a matrix form having rows and columns.

16. The lighting device according to claim 14, wherein the connection portion is made of a same material as the lenses and is integrally formed with the lenses.

17. The lighting device according to claim 11, further comprising:

a fixing unit disposed on the substrate in order to support the lens array unit.

18. The lighting device according to claim 11, wherein the size of the lens is a diameter of the lens.

19. The lighting device according to claim 11, wherein sizes of the lenses are proportional to a quantity of light from the light sources.

20. A lighting device comprising:

a housing including a lower plate and a side plate;

a light-emitting module including a substrate disposed on the lower plate and first light sources and second light sources disposed on the substrate, each of the second light sources being disposed between adjacent ones of the first light sources;

a lens array unit including first lenses arranged in alignment with the first light sources, second lenses arranged in alignment with the second light sources, and a connection portion for connecting the lenses; and an optical sheet disposed on the lens array unit, wherein a quantity of light from the first light sources is smaller than a quantity of light from the second light sources, separation distances between the first light sources and the second light sources adjacent to each other are identical to each other, and a size of each of the first lenses is smaller than a size of each of the second lenses, and wherein separation distances between the first lenses and the second lenses adjacent to each other is the same as each other.

* * * * *